US005351339A

United States Patent [19]

Reuber et al.

[11] Patent Number: 5,351,339

[45] Date of Patent: Oct. 4, 1994

[54] DOUBLE LENS ELECTRIC SHIELD

[75] Inventors: Douglas A. Reuber, Lindsay; Amsey Buehler, Cobourg, both of Canada

[73] Assignee: 546401 Ontario Limited, Lindsay, Canada

[21] Appl. No.: 25,873

[22] Filed: Mar. 3, 1993

[30] Foreign Application Priority Data

Feb. 3, 1993 [CA] Canada ..... 2090805

[51] Int. Cl.[5] ..... A42B 1/08

[52] U.S. Cl. ..... 2/9; 2/15; 2/424; 2/435; 219/211

[58] Field of Search ..... 2/7, 8, 9, 10, 15, 410, 2/422, 424, 425, 535, 6.3, 6.4, 6.5, 418, 417; 219/203, 211, 543, 147

[56] References Cited

U.S. PATENT DOCUMENTS

| | | | |
|---|---|---|---|
| 2,739,310 | 3/1956 | Frieder et al. | 2/418 |
| 2,747,191 | 5/1956 | Hoffmaster | 2/8 |
| 3,024,341 | 3/1962 | Ogle, Jr. et al. | 219/20 |
| 3,090,046 | 5/1963 | Bowers, Sr. | 2/8 |
| 3,137,005 | 6/1964 | Herbine et al. | 2/8 |
| 3,517,392 | 6/1970 | Hodge et al. | 2/8 |
| 3,787,894 | 1/1974 | Goodman, Jr. | 2/418 |
| 3,797,041 | 3/1974 | Raschke | 2/8 |
| 4,462,119 | 7/1984 | Rudd | 2/424 |
| 4,584,721 | 4/1986 | Yamamoto | 2/424 |
| 4,638,728 | 1/1987 | Elenewski | 2/435 |
| 4,668,270 | 5/1987 | Ramus | 219/203 |
| 4,682,007 | 7/1987 | Hollander | 219/211 |
| 4,868,929 | 9/1989 | Curcio | 2/435 |

FOREIGN PATENT DOCUMENTS

| | | | |
|---|---|---|---|
| 1201149 | 2/1986 | Canada . | |
| 1285976 | 7/1991 | Canada | 2/435 |
| 2091527 | 7/1982 | United Kingdom . | |

*Primary Examiner*—Clifford D. Crowder
*Assistant Examiner*—Michael A. Neas
*Attorney, Agent, or Firm*—Smart & Biggar

[57] ABSTRACT

Known protective helmets used for motorcycle riding, flying and snowmobiling employ transparent visors that have heating elements to reduce and attempt to eliminate the build-up of ice, condensation and fog. A double-lensed face shield is provided with a pair of electrodes formed on an inner face lens, in the air pocket formed between the inner face lens and the outer weather lens. Substantially across one entire surface of the inner face lens is formed an electroconductive film. An upper electrode extends from a first end along an upper margin of the inner face lens on the film to a second end. On the opposite lower margin extends on the film a lower electrode from a first end to a second end. An insulated contact passes from one side of the inner lens to the other and connects the first end of the lower electrode with a conductor which extends on the opposite side of the inner lens towards the first end of the upper electrode. Power supplied across the first end of the upper electrode and the tail end of the conductor will result in electrical flow across the film inhibiting fog, ice and frost. Also provided is an assembly to permit the installation of face shields on helmets of different sizes and with openings of different configurations.

9 Claims, 5 Drawing Sheets

DOUBLE LENS ELECTRIC SHIELD

The present invention relates generally to shield structures in particular to shield structures for protective helmets.

PRIOR ART

Shield structures for protective helmets are well known. For example, protective helmets used for snowmobiling and motorcycle riding typically have transparent shields or visors. One of the problems with such shield structures is that in certain climatic conditions, such as in rain, or cold weather, the transparent shield will fog or become iced. U.S. Pat. No. 3,024,341 which issued to Ogle et al. on Mar. 6, 1962 discloses a pilot's helmet with a transparent visor on the surface of which is deposited a transparent electrically conducting film. Olge also discloses sandwiching an electroconductive film between two transparent laminated sheets to form a visor. The result is a visor which may be electrically heated to reduce the build-up of fog, condensation or ice.

Various other variations are known in the heating of a transparent visor or shield on a protective helmet. For example, the applicant's own Canadian Patent No. 1,285,976 which issued on Jul. 9, 1991 discloses a double lens electric shield having a surface of one of the lenses printed with an electrically conductive circuit which is arranged in a pattern of continuous generally parallel lines or ribbons.

U.S. Pat. No. 4,584,721 which issued to Yamamoto on Apr. 29, 1986 discloses a transparent shield having a heat generating electroconductive film formed on the inner surface of the shield panel. In Yamamoto, the electroconductive film is deposited upon a heat generating plate which is secured to a support plate. The support plate is releasably attachable to the shield panel. Formed in parallel on the electroconductive film are a pair of electrodes. Yamamoto discloses several other arrangements of electrodes and electrical connections. When an electrical potential is applied between the pair of electrodes an electrical current will flow from one electrode across the electroconductive film to the other electrode, generating heat across the electroconductive film. The arrangement of the electrodes in Yamamoto attempt to provide a uniform or almost uniform heating of the electroconductive film.

In such a visor as disclosed in Yamamoto it is desirable to have the electric power leads for the upper and lower electrodes connected at the same side of the shield. Yamamoto discloses one such arrangement, in particular the use of one electrode having an extension portion also formed on the electroconductive film and a cut line in the film between the electrode and its extension.

There are however some drawbacks to this arrangement which the present invention seeks to overcome. It is possible that there could be an electrical short between the electrode and its extension across the cut line, at a point other than the connection point. The result would be that there would not be uniform heating of the electroconductive film.

Another problem associated with shields and visors is that the visor can become damaged, scratched, etc. In such circumstances it is not desirable to have to replace the entire protective helmet. To solve this problem it is already known to provide detachable visors for helmets. Yamamoto discloses a helmet to which a shield panel is removably attached by mount screws. However for a given helmet, if it is desired to replace the shield panel, it is necessary to use a shield panel that is specifically adapted and sized to attach with the mount screws. Thus, it may be necessary to have different shield panels for each of several slightly different sized helmets. The present invention also seeks overcome the disadvantages inherent with such shield panels by providing an adaptable shield panel which can be utilized with a wide range of helmet shapes and sizes.

SUMMARY OF THE INVENTION

According to one aspect of the invention, there is provided a face shield for a helmet comprising the following: a weather lens; a face lens spaced from said weather lens by spacer means so as to form an appreciable air gap between said weather lens and said face lens, said face lens having an inner layer and a backing layer, said inner layer having a surface facing said air gap; a first electrode extending along a margin of said inner layer on said air gap facing surface and a second electrode extending along a margin of said inner layer on said air gap facing surface opposite said first electrode; a contact extending from an end of said first electrode through said inner layer to a conductor, said conductor extending between said inner layer and said backing layer generally along said first electrode past a second end of said first electrode and toward an end of said second electrode; a terminal connector extending to said end of said second electrode and to an end of said conductor which is proximate said end of said second electrode, said terminal connector for connecting to a source of electrical power; a transparent conductive film extending between said first and said second electrode on said air gap facing surface, said film having sufficient electrical resistance to create heat effective to inhibit formation of fog, ice or frost upon said face shield when said terminal connector is connected to a source of electrical power.

DESCRIPTION OF THE PREFERRED EMBODIMENTS

Figure 1A:
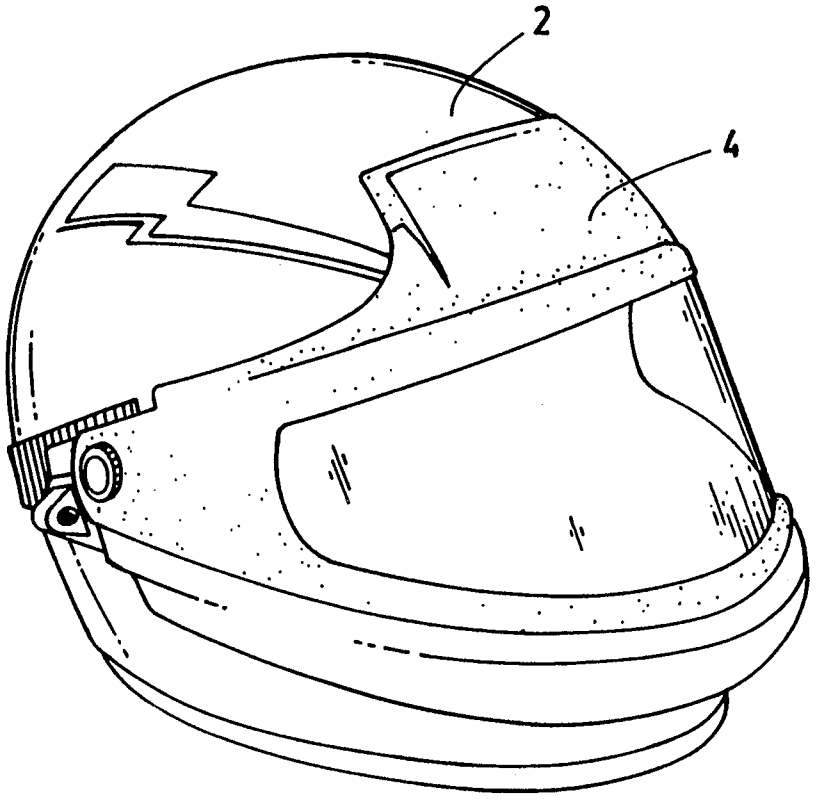
FIG. 1A is a perspective view of a protective helmet employing a face shield made in accordance with an embodiment of this invention.
Figure 1B:
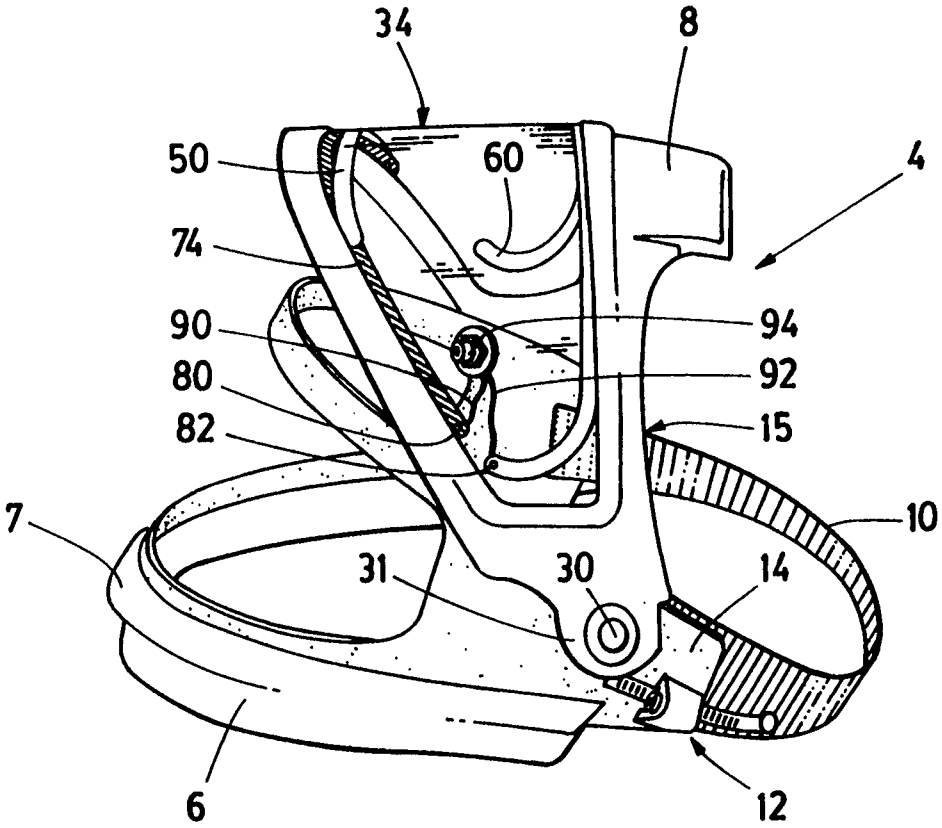
FIG. 1B is a perspective view of a face shield for a helmet made in accordance an embodiment of the invention.

FIG. 1A shows a helmet 2 having a face shield generally depicted as 4. As shown in Figure 1B face shield 4 comprises a housing 8 secured to a frame 6 having a lip 7. Housing 8 and frame 6 are preferably made from ABS and consequently have some flexibility. Polycarbonate is another possible choice of material. Both frame 6 and housing 8 are generally curved and shaped to fit over and around the opening of helmet 2 as shown in FIG. 1A.

Attached to frame 6 is a flexible band 10 secured by adjustable attachment means generally designated 12.

Figure 2:
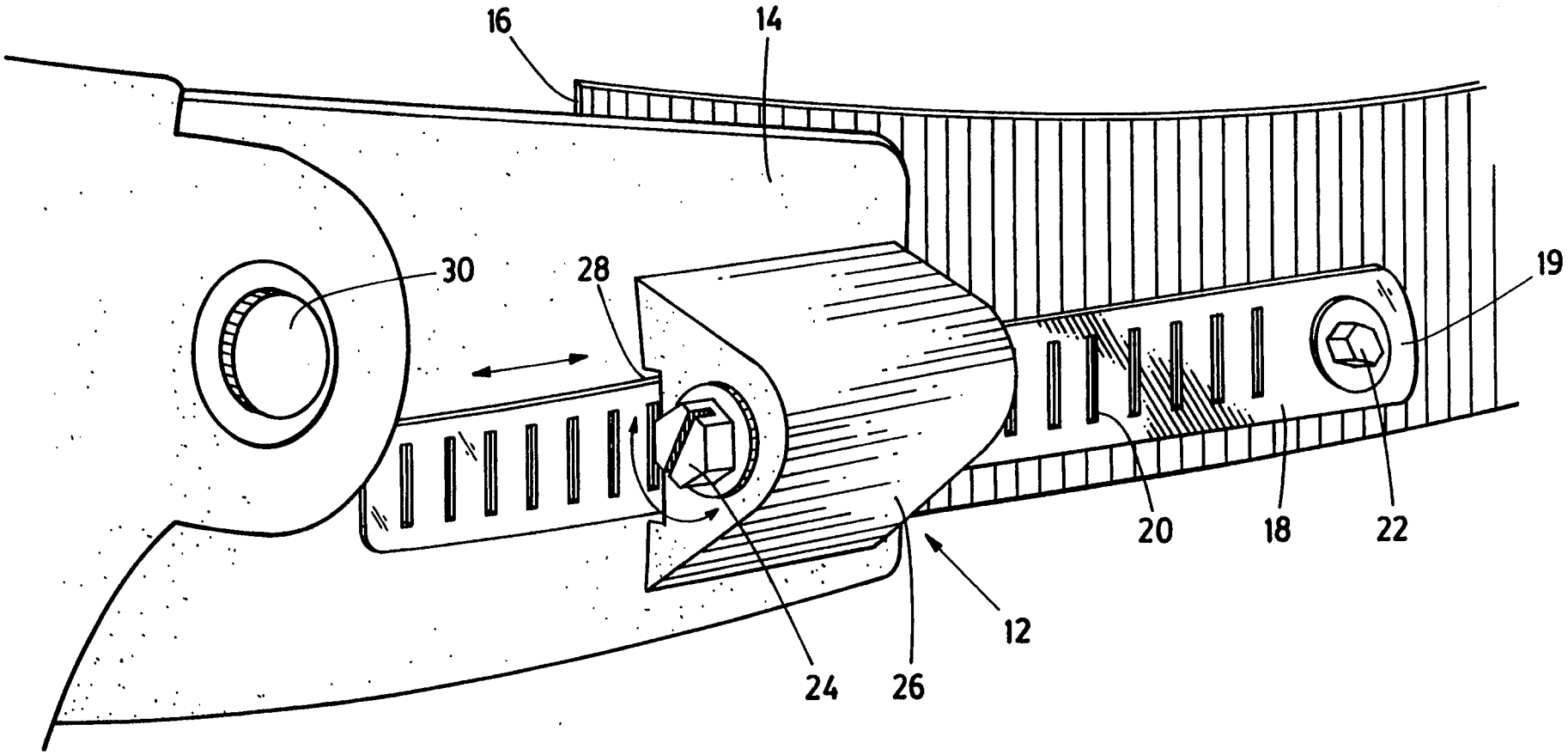
FIG. 2 is an enlarged perspective view of part of the face shield shown in FIG. 1B.

Frame 6 may only have a single attachment means 12 located at the rear side portion 14 of frame 6. Alternatively in a preferred embodiment, frame 6 may have a second attachment means (not shown) located at the opposite rear side portion 15 of frame 6. As depicted in FIG. 2, the attachment means 12 comprises a track 18, a screw housing 26, and a screw 24. A first end 19 of track 18 is secured well behind leading edge 16 of flexible band 10. Track 18 is typically made from a durable plastic or metal and has a series of parallel-spaced longitudinal openings 20. The track 18 is secured at first end 19 to flexible band 10 by a conventional bolt and nut combination generally designated 22. Flexible band 10 can pivot relative to track 18 at bolt-nut combination 22. Screw 24 is received and held in a position generally parallel to track 18 in screw housing 26 but is free to rotate therein. Screw housing 26 which is attached to, or may be integrally formed with the rear side portion 14 of frame 6 has a slot 28 running longitudinally through it. Screw 24 is positioned so that its threads (not shown) will engage openings 20 of track 18. Rotation of screw 24 in one direction will cause track 16 to be drawn through slot 28 thereby tightening flexible band 10 around helmet 2. Rotation of screw 24 in the opposite direction will push track 18 in the opposite direction. This adjustment device permits the housing 8 and frame 6 to be adapted to fit a variety of helmets of different sizes and shapes.

Returning to FIG. 1B, housing 8 is secured to frame 6 proximate the opposed attachment means 12 by a conventional threaded bolt (not shown) which passes through openings (not shown) in the opposed side portions 31 of housing 14 and are secured by a pair of threaded nuts 30. As housing 8 is somewhat flexible, if nuts 30 are removed, housing 8 can be removed from frame 6.

Housing 8 can pivot relative to frame 6 about the opposed pivots created by bolts and nuts 31. Housing 8 is movable and pivots between a closed position wherein the housing rests on lip 7 of frame 6, as depicted in FIG. 1A, and an open position as shown in FIG. 1B.

The provision of attachment means 12 on frame 6 permits the face shield 4 to be utilized with helmets having different sized openings and being of different sizes, and can be used on helmets with or without electrical heating devices.

Figure 3:
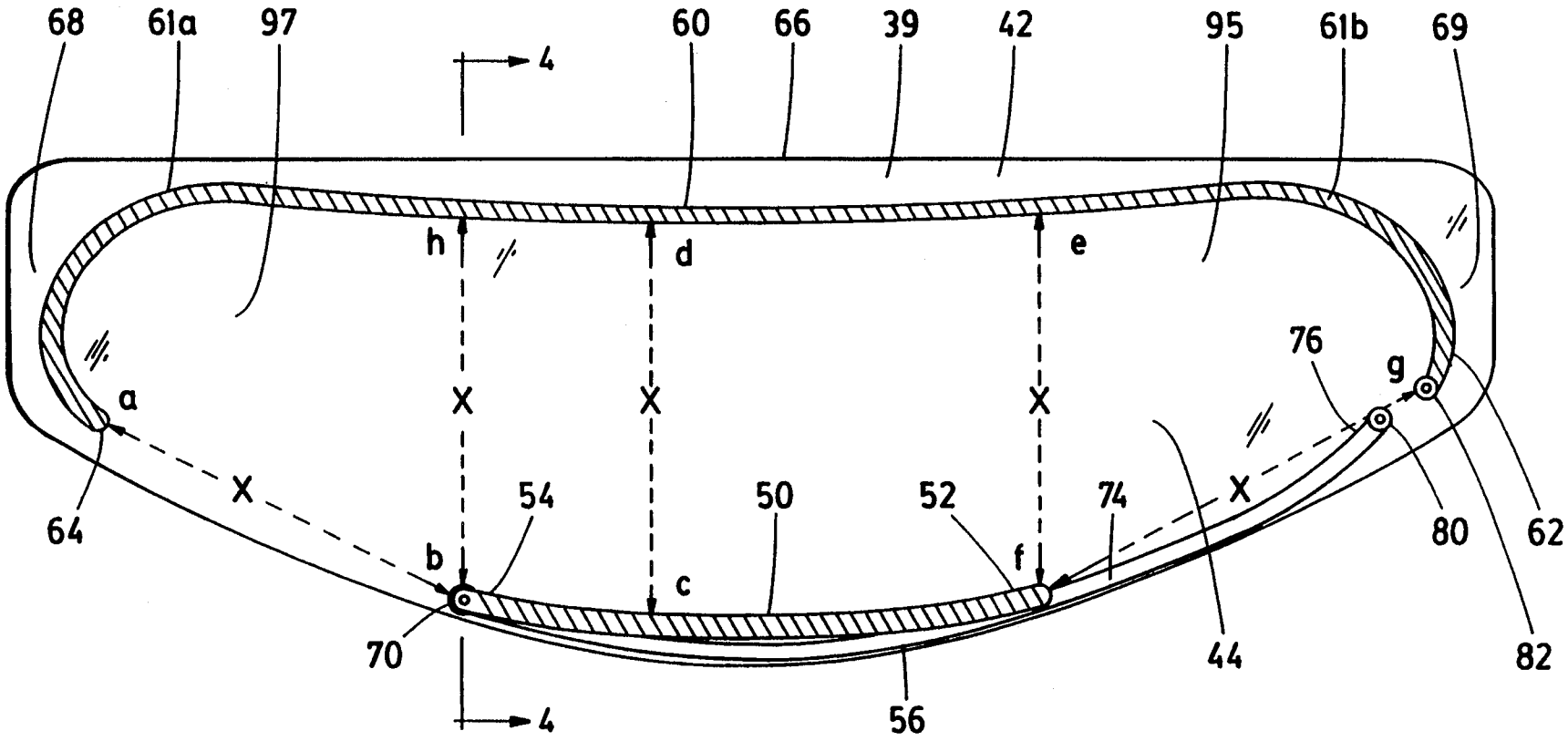
FIG. 3 is a flattened plan view of part of the face lens of FIG. 1.
Figure 4:
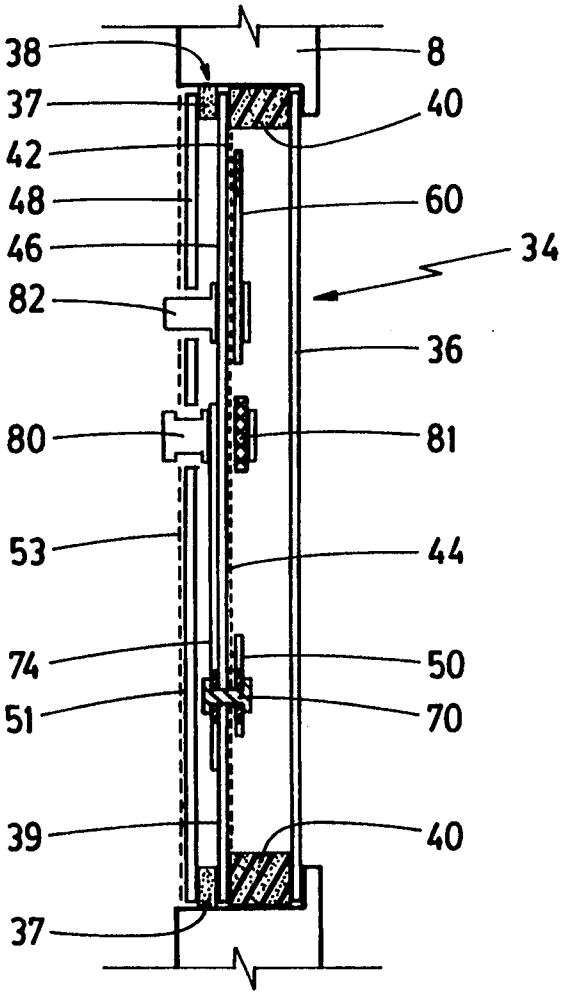
FIG. 4 is a cross-sectional view along the lines 4—4 of the face lens shown in FIG. 3.

Housing 8 has an opening which is filled by a lens assembly 34. Housing 8 supports lens assembly 34 at its periphery. Turning to FIGS. 3 and 4, lens assembly 34 comprises a transparent outer weather lens 36 and a transparent inner face lens 38. In the embodiment shown, the weather lens and the inner face lens are coextensive. Weather lens 36 is spaced from face lens 38 by upper and lower spacers generally designed as 40. Spacers 40 are typically made from a material such as neoprene. The spacing of weather lens 36 and face lens 38 provides an air pocket therebetween, which preferably is sealed.

Face lens 38 comprises a transparent inner layer 39 and a transparent backing layer 48. In the embodiment shown in FIG. 4 inner layer is spaced from backing layer 48 by spacers 37. However, in another preferred embodiment, inner layer 39 is laminated to backing layer 48.

Backing layer 48 has a rear face 51 to which may be applied an anti-fog coating 53 substantially across its entire surface. Anti-fog coating 53 may be either a hydrophillic coating or a hydrophobic coating, and will inhibit the build-up of fog on the rear face 51.

FIG. 3 shows inner layer 39 as it would appear if flattened out. Inner layer 39 has an air gap facing surface 42 to which is applied a transparent electroconductive film 44, which substantially covers the air gap facing surface. A preferred embodiment of the inner layer 39 and the electroconductive film 44 is a composite product comprising a PET substrate (polyester) to which is applied by sputter coating, a thin layer of indium tin oxide (ITO). Such an ITO coating provides high visible light transmission, low reflectivity and uniform electrical conductivity. Backing layer 48 is preferably made from a material such as a polycarbonate, butyrate or an acrylic.

Applied to the air gap facing surface 42 of inner layer 39 on top of electroconductive film 44 is a first lower electrode 50 having a first end 52 and second end 54. The first electrode extends generally along and adjacent a portion of the lower margin 56 of inner layer 38. A second upper electrode 60 has a first end 62 and a second end 64 and extends along the upper margin 66 and along side margins 68 and 69 of inner layer 39. As shown in FIG. 3, the first end 62 of second electrode 60 is more proximate the first end 52 of first electrode 50 than the second end 54 of first electrode 50. The inner layer 39 is shaped to fit the opening in housing 8. As shown in FIG. 3, the edge of the inner layer 39 adjacent the margin 56 along which first electrode 50 extends is convexly radiused. The opposite edge of inner layer 39 adjacent the upper margin 66 along which second electrode 60 extends is substantially straight. First electrode 50 and second electrode 60 are preferably made from an electrically conductive silk screen ink.

A contact 70 passes through inner layer 39 and connects second end 54 of first electrode 50 to an end 72 of a conductor 74. Conductor 74 is also typically made from an electrically conductive silk screen ink and extends along the rear face 46 of inner layer 39, generally along the first electrode 50, past the end 52 towards the first margin 69 and towards end 62 of second electrode 60 terminating in end 76. If inner layer 39 is laminated to backing layer 48, conductor 74 is sandwiched therebetween. This backing layer 48 will protect conductor 74.

Conductor 74 has a terminal connector 80 connected to its end 76. Terminal 80 is electrically insulated by an insulator 81 from the electroconductive film on air gap facing surface 42. At end 62 of second electrode 60, a second connector 82, which passes through both backing layer 48 and inner layer 39, is connected to the second electrode 60. An electric potential may be applied across terminals 80 and 82 which results in an electrical potential between first electrode 50 and second electrode 60 so that an electrical current will flow across electroconductive film 44 between the first electrode and the second electrode. Clearly the electrodes have some resistivity. Consequently, there is a small potential drop across their length.

As shown in FIG. 1B (not shown in the other Figures) connected to terminal connectors 80,82 are a pair of power leads 90,92 which leads to a co-axial connector 94. Co-axial connector 94 is suitable for connection to an electrical power source. The power supplied to terminal connectors 80 and 82 may be direct current or alternating current.

Returning again to FIG. 3, point b is the point of maximum electrical potential of electrode 50 and is positioned toward side 68 on the opposite side of the inner layer 39 from point g which is positioned toward the side 69 and is the point of maximum opposite electrical potential on electrode 60. Although there will be some loss of potential along the length of both electrodes because they are not perfect conductors, most of the potential drop will occur across the electroconductive film 44. Sufficient heat may be generated to inhibit formation of fog, ice or frost upon the face shield. The upper and lower electrodes are formed on the electroconductive film so that for any given point on an electrode, the shortest distance to the other electrode is approximately the same. For example, the upper electrode 60 is shaped with a curved portion 61*a*. This results in the distance x between point a on electrode 60 and point b on electrode 50 being approximately the same as the distance x between point d on electrode 60 and point c on electrode 50. Thus the potential drop from any point along the length of electrode 50 to the closest point on electrode 60 will be for most part, substantially the same. This results in a fairly uniform flow of electrical current across electroconductive film 44, particularly in the rectangular section of the electroconductive film 44 defined by points h, e, f and b and results in fairly uniform heating in this region. This rectangular region is the most critical portion of inner layer 39 requiring heating as this is where most visibility is required for the face shield. However, there will be some electrical flow between electrode 50 across the film to curved portions 61*a* and 61b, thus producing heating of the side portions 95,97 outside of rectangular section d,e,f,b.

Other variations and modifications are possible and within the scope of the invention.

We claim:

1. A face shield for a helmet comprising the following:

a weather lens;

a face lens spaced from said weather lens by spacer means so as to form an appreciable air gap between said weather lens and said face lens, said face lens having an inner layer and a backing layer, said inner layer having a surface facing said air gap;

a first electrode extending along a margin of said inner layer on said air gap facing surface and a second electrode extending along a margin of said inner layer on said air gap facing surface opposite said first electrode;

a contact extending from an end of said first electrode through said inner layer to a conductor, said conductor extending between said inner layer and said backing layer generally along said first electrode past a second end of said first electrode and toward an end of said second electrode;

a terminal connector extending to said end of said second electrode and to an end of said conductor which is proximate said end of said second electrode, said terminal connector for connecting to a source of electrical power;

a transparent conductive film extending between said first and said second electrode on said air gap facing surface, said film having sufficient electrical resistance to create heat effective to inhibit formation of fog, ice or frost upon said face shield when said terminal connector is connected to a source of electrical power.

2. The face shield of claim 1 wherein an edge of said inner layer adjacent said margin along which said first electrode extends is convexly radiused and wherein an edge of said inner layer adjacent said margin along which said second electrode extends is straight.

3. The face shield of claim 2 wherein the distance between any given point on said first electrode and the closest point on said second electrode to said given point is approximately the same as the distance between any further given point on said first electrode and the closest point on said second electrode to said further given point.

4. The face shield of claim 3 wherein said lenses are coextensive and said transparent conductive film substantially covers said air gap facing surface.

5. The face shield of claim 4 including seal means disposed about the periphery of said lenses to at least substantially seal said air gap.

6. The face shield of claim 5 in which the material from which the face lens is manufactured is selected from the group consisting of polycarbonates, butyrate and acrylics.

7. The face shield of claim 1 including a housing extending about the periphery of said face lens and said weather lens to support said face lens and said weather lens, and a frame having a lip, said housing joined to said frame at opposed pivots and moveable between a first closed position whereat said housing is seated on said lip and a second open position whereat said housing is pivoted away from said lip and including means for attaching said frame to a helmet.

8. The face shield of claim 7 wherein said helmet attachment means comprises a flexible band attached to said frame proximate to said pivots.

9. The face shield of claim 8 wherein said attachment means further comprises a screw associated with said frame and a track attached to said band and extending along the side of said screw such that rotation of said screw either pushes out or draws in said track in order to respectively lengthen or shorten the effective length of said band.

* * * * *